US011198528B2

(12) United States Patent
Prinz et al.

(10) Patent No.: US 11,198,528 B2
(45) Date of Patent: Dec. 14, 2021

(54) PACKAGING DEVICE AND METHOD FOR FITTING AN EXTERNAL PACKAGE WITH A DIVIDING ELEMENT

(71) Applicant: KRONES Aktiengesellschaft, Neutraubling (DE)

(72) Inventors: Markus Prinz, Tuntenhausen (DE); Simon Aigner, Marquartstein (DE); Rolf Immanuel Trussina-Kaidel, Rosenheim (DE)

(73) Assignee: KRONES Aktiengesellschaft, Neutraubling (DE)

( * ) Notice: Subject to any disclaimer, the term of this patent is extended or adjusted under 35 U.S.C. 154(b) by 169 days.

(21) Appl. No.: 16/267,556

(22) Filed: Feb. 5, 2019

(65) Prior Publication Data

US 2019/0248522 A1 Aug. 15, 2019

(30) Foreign Application Priority Data

Feb. 13, 2018 (DE) ..... 10 2018 103 176.9

(51) Int. Cl.
*B65B 21/18* (2006.01)
*B65B 35/38* (2006.01)
(Continued)

(52) U.S. Cl.
CPC ..... *B65B 21/18* (2013.01); *B65B 5/08* (2013.01); *B65B 35/38* (2013.01); *B65B 61/207* (2013.01); *B65D 5/48038* (2013.01)

(58) Field of Classification Search
CPC ..... B65B 21/18; B65B 5/08; B65B 35/38; B65D 5/48038
See application file for complete search history.

(56) References Cited

U.S. PATENT DOCUMENTS 3,057,136 A * 10/1962 Walter ..... B65B 39/006 53/262
3,555,770 A * 1/1971 Rowekamp ..... B65B 21/18 53/495

(Continued)

FOREIGN PATENT DOCUMENTS

CN 104828288 B 3/2017
CN 105416722 B 7/2018

(Continued)

OTHER PUBLICATIONS

German Patent Application DE 10 2018 103 176.9 filed Feb. 13, 2018—German Search Report dated Sep. 18, 2018.

(Continued)

*Primary Examiner* — Nathaniel C Chukwurah
*Assistant Examiner* — Lucas E. A. Palmer
(74) *Attorney, Agent, or Firm* — Simmons Perrine Moyer Bergman PLC

(57) ABSTRACT

The invention relates to a packaging device (1) and method for fitting an external package (3) with a dividing element (2) and for filling a divided external package (3) with articles (4). The packaging device (1) comprises a first supply station (70) for external packages (3) that are open on one side, a second supply station (60) for expanded and/or unfolded dividing elements (2), a placement device (6) for placing the expanded and/or unfolded dividing element (2) into the external package (3), at least one holding device (9) that holds and/or stabilizes the expanded and/or unfolded dividing element (2) inside the external package (3) prior to the articles (3) being placed therein, and an article feed station (11) for placing the articles (4) into an external package (3) that is divided by the dividing element (2).

10 Claims, 4 Drawing Sheets

(51) Int. Cl.

| | |
|---|---|
| ***B65B 5/08*** | (2006.01) |
| ***B65D 5/49*** | (2006.01) |
| ***B65B 61/20*** | (2006.01) |

(56) References Cited

U.S. PATENT DOCUMENTS

| | | | | | |
|---|---|---|---|---|---|
| 3,570,216 | A * | 3/1971 | Frentzel | B65B 21/16 | 53/248 |
| 3,601,951 | A * | 8/1971 | Bargel | B65B 21/18 | 53/497 |
| 3,672,117 | A * | 6/1972 | Shuttleworth | B65B 5/06 | 53/473 |
| 3,788,034 | A * | 1/1974 | Hartness | B65B 39/006 | 53/248 |
| 3,926,336 | A * | 12/1975 | Graham | B65B 21/16 | 221/296 |
| 4,151,788 | A * | 5/1979 | Wiseman | B31B 50/00 | 493/91 |
| 4,175,364 | A * | 11/1979 | Becker | B65B 39/006 | 53/248 |
| 4,300,330 | A * | 11/1981 | Hartness | B65B 21/04 | 294/87.24 |
| 4,829,747 | A * | 5/1989 | Johnson, Jr. | B65B 61/207 | 493/91 |
| 4,833,860 | A * | 5/1989 | Hartness | B65B 39/006 | 53/261 |
| 5,394,673 | A * | 3/1995 | Hartness | B65B 39/006 | 53/248 |
| 6,128,886 | A * | 10/2000 | Johnson, Jr. | B65B 61/207 | 493/91 |
| 6,571,532 | B1 * | 6/2003 | Wiernicki | B65B 21/183 | 414/225.01 |
| 6,722,101 | B2 * | 4/2004 | Hartness | B65B 21/183 | 53/247 |
| 6,983,577 | B2 | 1/2006 | Hartness et al. | | |
| 2002/0150458 | A1 * | 10/2002 | Hartness | B65B 21/183 | 414/744.3 |
| 2011/0030311 | A1 | 2/2011 | Martini | | |
| 2016/0107408 | A1 * | 4/2016 | Hutter | B65B 43/305 | 493/313 |
| 2016/0107782 | A1 * | 4/2016 | Hutter | B65B 21/18 | 53/467 |
| 2017/0313452 | A1 * | 11/2017 | Sutton | B65G 15/00 | |

FOREIGN PATENT DOCUMENTS

| | | |
|---|---|---|
| DE | 3431006 C1 | 3/1986 |
| DE | 4034639 A1 | 5/1991 |
| DE | 60301310 | 6/2006 |
| EP | 0901968 A1 | 3/1999 |
| FR | 2654071 B1 | 4/1994 |

OTHER PUBLICATIONS

EP18208732—Extended European Search Report dated Jun. 17, 2019.
First Chinese Office Action dated Sep. 2, 2020.

* cited by examiner

PACKAGING DEVICE AND METHOD FOR FITTING AN EXTERNAL PACKAGE WITH A DIVIDING ELEMENT

CLAIM OF PRIORITY

The present application claims priority to German Application 10 2018 103 176.9, filed Feb. 13, 2018, which is incorporated by reference.

FIELD OF THE INVENTION

The present invention relates to a packaging device for fitting an external package with a dividing element and for filling a suchlike divided external package with articles. The invention moreover relates to a method for fitting an external package with a dividing element.

BACKGROUND OF THE INVENTION

When packing bottles or other articles into so-called RSC boxes (or so-called Regular Slotted Container boxes), partitions are frequently used as dividing elements in order to prevent a contact of the bottles or articles with one another. A specific form of partition is the so-called 3×2 A-partition with two short flaps that are connected on one side. A exemplary partition is described in the patent application publication EP 901 968 A1, for example.

In the process of packaging, it is possible to first place the bottles into the box and to subsequently slide or fit the partition over the bottles or to place it between the bottles. Alternatively, the partition can be placed into the box first, and the bottles are subsequently placed into the box that has been divided by the partition. The already known 3×2 A-partition has only one central web in longitudinal direction. This involves the risk, however, that the 3×2 A-partition can relatively easily collapse after having been placed into the box. It is therefore not guaranteed that the bottles can be placed safely into the RSC box with the 3×2 A-partition. If the above-described second filling variant is used, with the partition being placed into the box first and subsequently the bottles, a collapse of the partition prior to the bottles being placed therein must be particularly prevented.

In order to avoid this, methods have become known in which the partition is glued into the box, for example. The gluing of the partitions into the box in this filling variant, however, involves the problem of leaving glue residues, which can in turn stick to the bottles or articles or to the box itself. This results in the risk, among others, of the bottles or articles sticking to the box.

The object of the invention is to stabilize an unfolded form or shape of a dividing element, in particular, a partition, prior to and/or while the articles are being placed into an external package that is fitted with the dividing element.

The above object is solved by a packaging device and a method for fitting an external package with a dividing element, the packaging device and the method comprising the features of the independent claims. Further advantageous embodiments of the invention are described in the subclaims.

SUMMARY OF THE INVENTION

The invention relates to a packaging device for fitting an external package with a dividing element and for filling a suchlike divided external package with articles, in particular, by the method that is likewise described below.

The term "external package" in the present context is to be understood, in particular, as a box packaging of a dimensionally stable material, for example, of stabilized paper types, such as cardboard or paperboard, plastic, a composite material, or the like. In particular, this means an external package that already largely has its final shape, but is open on one side. The external package to be fitted with dividing element and articles can be, for example, an RSC carton that is open on one side, in particular, with box flaps that are open on one side and that can be closed by being folded over and by being glued or the like after the RSC carton has been filled with articles.

If "articles" are generally referred to in the present context, these can be, for example, liquid containers, such as PET bottles, metal cans, containers for pasty material, etc. Frequent fields of application for suchlike external packages with partitions placed therein are packaging logistics and/or transport logistics in the sector of the beverage industry, such that articles in the sense of the present description can be formed, for example, by beverage-filled beverage containers made of glass or PET or of other suitable plastics.

The external packages that are open on one side are fed to the packaging device by a first supply station. The first supply station can be formed, for example, by a first transport device that supplies the external packages with one side open from a folding device that produces the external packages, for example. The terms "external package" and "box" will be used synonymously herein.

The packaging device furthermore comprises a second supply station for expanded and/or unfolded dividing elements, for example partitions, in particular 3×2 A-partitions. Partitions are preferentially produced from single- or multi-part carton board of stabilized paper types, such as cardboard and/or paperboard, for example. There are carton boards in different thicknesses and sizes for all types of partitions. Corrugated cardboard can be used, for example, to protect sensitive articles. Instead of "dividing element", the term "partition" will be synonymously used below; the described device and the method are particularly suited for the use of 3×2 A-partitions, which are in themselves unstable.

The device and the method can be used for all forms of partitions known to the person skilled in the art. The partitions are supplied in a magazine, for example, folded together so as to save space. By a suitable removal device with expanding implement, the partitions are removed from the magazine and expanded and/or unfolded to their desired form and subsequently placed into the external package. In particular, it can be provided that the removal device simultaneously serves as placement device for the expanded and/or unfolded partition.

Furthermore, at least one holding device is provided that holds and/or stabilizes the expanded and/or unfolded partition. This holding device holds and stabilizes the partition, in particular, prior to the articles being placed into the box. The partition can be effectively prevented from collapsing to its folded state for storage by using the holding device.

The packaging device moreover comprises at least one article feed station, which supplies the articles to be placed into the box, and which places the articles into the box that has been divided into a plurality of compartments by the partition.

In the method according to the present invention, the partition is placed at least with some sections into the box. According to a preferred embodiment of the invention, it is provided that the partition is disposed by the placement device with only some sections inside the external package and thus protrudes at least with some sections out of the at least one open side of the external package and beyond the external package. For holding and/or stabilizing the partition, the at least one holding device takes hold of the partition at the section thereof that protrudes out of the box. The holding device is formed, for example, by a vacuum cup that suctions to a surface of the partition protruding out of the box and that thereby prevents the partition from collapsing to its planar, folded state for storage. This holding effect and/or stabilizing effect results, in particular, from oppositely acting forces of the delimiting lateral surface of the box on the one hand and of the holding device on the other hand.

The packaging device can furthermore comprise a transfer device, by which the box that is fitted with a partition is transferred to the article feed station, where the articles are inserted into the box, in particular into the divisions formed by the partition inside the box.

It is preferably provided that the holding device holds and/or stabilizes the partition is assigned to the transfer device and is thus moved to the article feed station by the transfer device and together with the box. Thus, it can be ensured that the partition is held and/or stabilized safely in relation to and with some sections inside the box over the entire transfer time.

A second holding device for the box can moreover be provided, with the second holding device that also holds and/or stabilizes the box during the transfer of the box and the partition to the article feed station. The second holding device, in particular, prevents a relative movement of the box in relation to the partition that is being held and stabilized by the first holding device. The second holding device is preferably likewise disposed at the transfer device such that the first and the second holding device are moved along toward the article feed station synchronously with the movement of the transfer device. Analogously to the first holding device, the second holding device can likewise be designed as vacuum cup that suctions to a surface of the box. Preferably, the first holding device is disposed above the second holding device.

According to one embodiment of the invention, the article feed station comprises at least one stabilizing device that holds and/or stabilizes the partition inside the box when the box is located within the article feed station. The article feed station comprises article insertion aids, for example, that ensure and/or enable a safe and precisely positioned insertion of the articles into the compartments formed by the partition inside the box. These insertion aids are, for example, inserted into the compartments formed by the partition while the partition is still being held and/or stabilized by the first holding device. The article insertion aids are designed such that they effectively prevent the partition from collapsing to its flat state for storage. As soon as the insertion aids are disposed inside the compartments of the partition, the first holding device can be disengaged from the partition. The vacuum produced by the vacuum cup is dissipated, for example, such that the first holding device can disengage from the partition when the transfer device is returned toward the first supply station. If provided, the second holding device is disengaged from the box preferably at the same time, for example by dissipation of the vacuum, such that no more contacts remain between the first holding device and the partition and between the second holding device and the box when the transfer device is returned toward the first supply station.

After the first holding device has been removed, the partition can then e completely inserted and/or accommodated into the box, for example by the partition sliding downward into the box. In this connection, the insertion aids of the article feed station are inserted so far into the box that they continue to stabilize the form of the divided compartments and of the entire partition even when the partition is disposed in its end position and completely accommodated in the box. Now, the articles can be fed and inserted into the box, with the articles being placed, in particular, into the compartments formed by the partition. The insertion aids support the insertion of the articles in the process. In particular, the insertion aids form guiding device and thus, for example, prevent the articles from contacting the cross webs of the partition while being inserted into the box, which could otherwise lead to damaging the labels.

By the packaging device and the method described herein, the partition is held and/or stabilized by a first holding device both during the transfer of the box that has been fitted with a partition into an article feed station where the particular articles are introduced into the box that is divided by the partition, and at least temporarily during the preparation of the box within the article feed station. Furthermore, the partition also continues to be held and/or stabilized during the insertion of the articles into the box, for example by a further stabilizing device that can be, in particular, a component of the article feed station. The stabilizing device can preferably comprise a further, supporting function while the articles are being inserted into the box.

It should be explicitly mentioned at this point that all aspects and embodiment variants explained in the context of the device according to the invention can likewise pertain to or constitute partial aspects of the method according to the invention. If specific aspects and/or interrelations and/or effects relating to the device according to the invention are referred to at some point in the present description or in the claims definitions, this therefore likewise pertains to the method according to the invention. The same applies conversely, so that all aspects and embodiment variants explained in the context of the method according to the invention can likewise pertain to or constitute partial aspects of the device according to the invention. If specific aspects and/or interrelations and/or effects relating to the method according to the invention are referred to at some point in the present description or in the claims definitions, this therefore likewise pertains to the device according to the invention.

BRIEF DESCRIPTION OF THE FIGURES

In the following passages, the attached figures illustrate exemplary embodiments of the invention and their advantages in more detail. The size ratios of the individual elements in the figures do not necessarily reflect the real size ratios. It is to be understood that in some instances various aspects of the invention may be shown exaggerated or enlarged in relation to other elements to facilitate an understanding of the invention.

Figure 1:
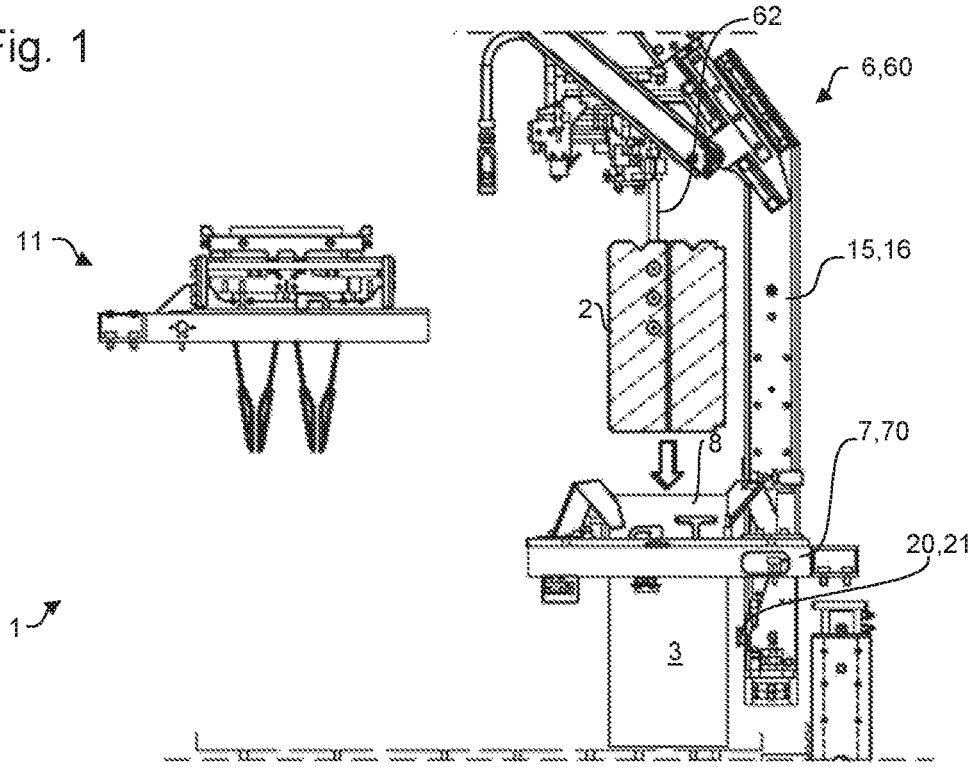
FIGS. 1 to 8 show a packaging device and a method sequence when placing a dividing element into an external package and the subsequent filling of the external package with articles.

The same or equivalent elements of the invention are designated using identical reference characters. Furthermore and for the sake of clarity, only the reference characters relevant for describing the individual figures are provided. It should be understood that the detailed description and specific examples of the embodiments of the apparatus or of the method according to the invention are intended for purposes of illustration only and are not intended to limit the scope of the invention.

DETAILED DESCRIPTION OF THE INVENTION

The schematic FIGS. 1 to 8 show an expedient embodiment variant of a packaging device 1 according to the invention as well as a method sequence when placing a dividing element into an external package and the subsequent filling of the external package with articles 4. A packaging device 1 suited for carrying out the method comprises a first supply station 70 for external packages, for example for boxes 3, and a second supply station 60 for dividing elements, for example partitions 2. The second supply station 60 can comprise a magazine (not illustrated here) for folded partitions 2, a removal device for removing a folded partition 2 from the magazine, a partition expanding implement 62 for unfolding and/or expanding the partition 2, as well as a placement device 6 for placing the unfolded and/or expanded partition 2 into the box 3. In this context, the partition expanding implement 62 and the placement device 6, for example, can at least in parts be formed by the same components.

The packaging device 1 furthermore comprises an article feed station 11 in order to fill a box 3 that is divided by a partition 2 with articles 4 (cf. FIGS. 7 and 8), in particular with bottles 5 or other suitable products. In particular, a plurality of compartments is formed inside the box 3 by the partition 2. Preferably, one compartment is in each instance provided for each article 4 to be disposed inside the box 3 such that the articles 4 have no direct contact with each other inside the box 3. Friction between the articles 4 is prevented in this way, and the articles 4 are accordingly protected from damage. This is particularly advantageous for transporting glass bottles or similarly sensitive products.

Partitions 2 and/or external packages, for example boxes 3, are preferentially produced from single- or multi-part carton boards of stabilized paper, such as cardboard and/or paperboard, for example. There are carton boards in different thicknesses and sizes for all types of partitions 2 and/or external packages. Corrugated cardboard can be used as packaging, for example, to protect sensitive articles.

The placement device 6 removes a prepared, folded blank for a partition 2 from a magazine or the like and expands the partition 2 by a suitable partition expanding implement 62, such as is described in the patent document EP 3 012 201 B1, the contents of which are hereby considered to be known to the person skilled in the art.

Unfolding or expanding a folded and unfoldable partition 2 results in a so-called division into a plurality of individual compartments, with each compartment being accessible via an access opening through which articles 4 (cf. FIGS. 7, 8) are introduced into the corresponding compartment.

The unfolded partition 2 is inserted from above at least with some sections into a box 3 that is open at the top. The box 3 that is open at the top in particular has top box flaps 8 that are open and that can be folded over and closed in a subsequent method step after the box 3 has been filled with articles 4. The box 3 is supplied by a first transport device of the first supply station 70, for example. The position and/or alignment of the box 3 is determined within the packaging device 1 by a suitable holding frame 7, which can likewise be a component of the first supply station 70. The partition 2 can thereby be inserted precisely positioned into the box 3. The holding frame 7 is guided, for example, from above over the box 3 that has been supplied by the first transport device.

Figure 2:
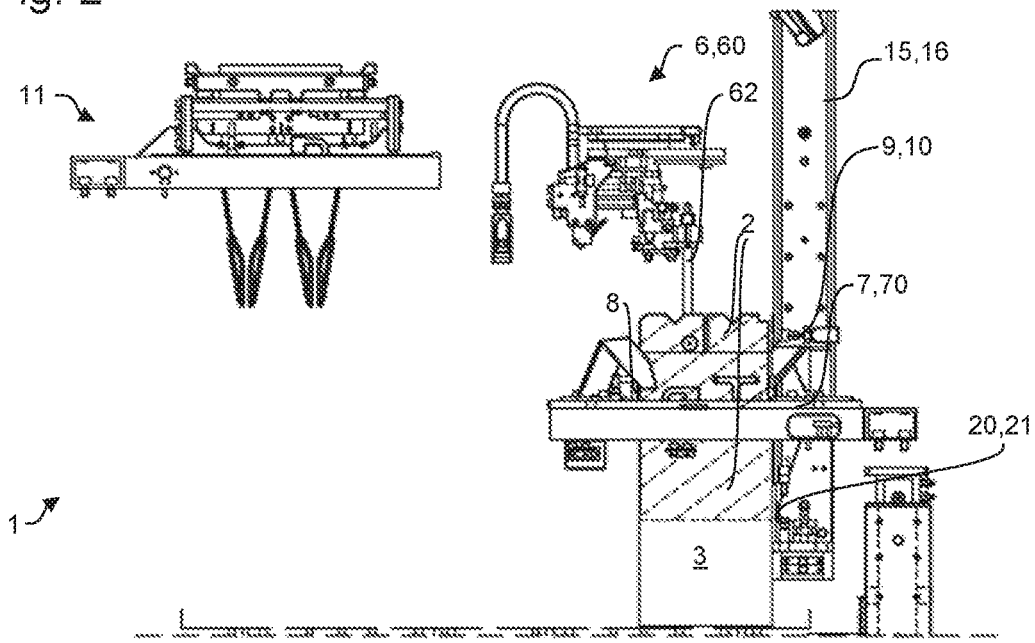
Figure 3:
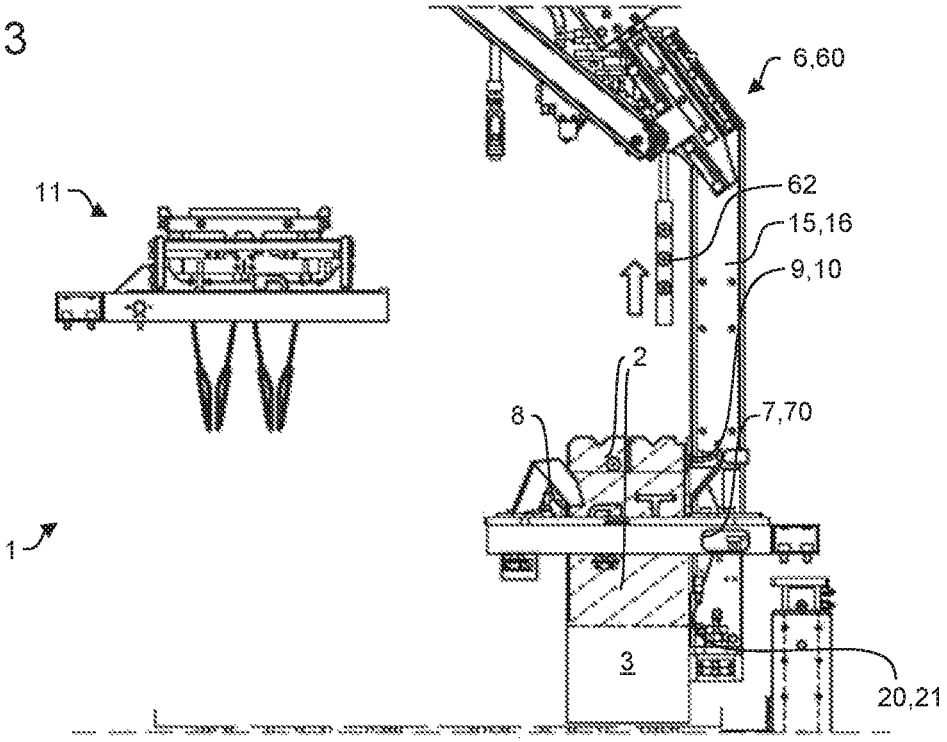
Figure 4:
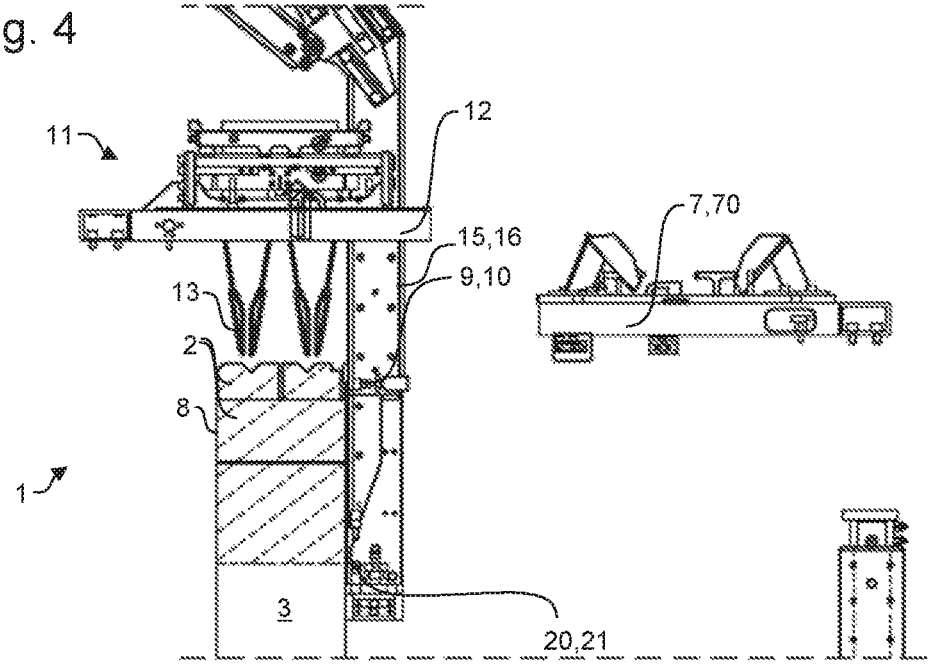
Figure 5:
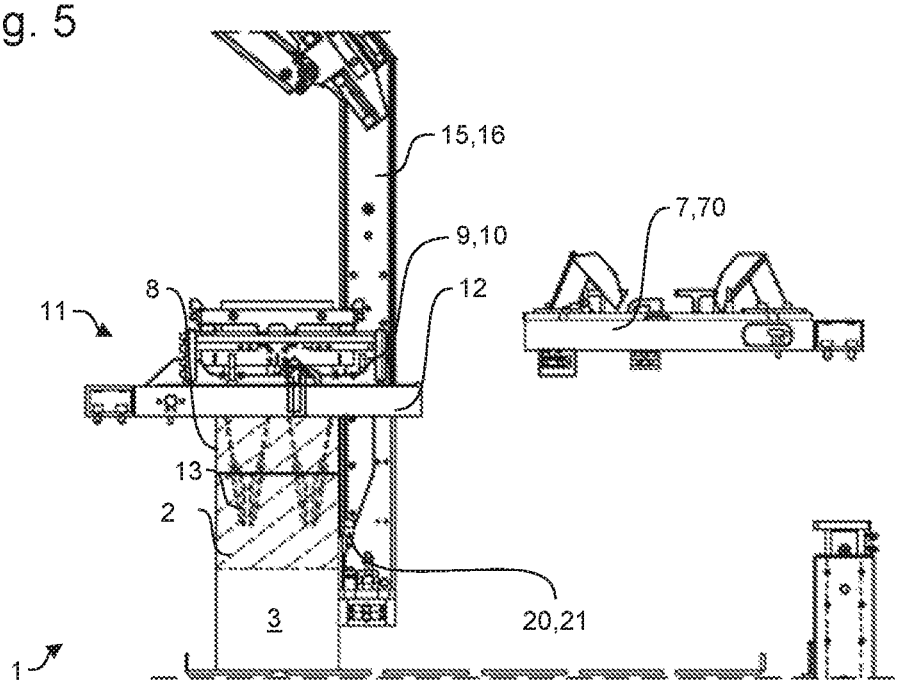
Figure 6:
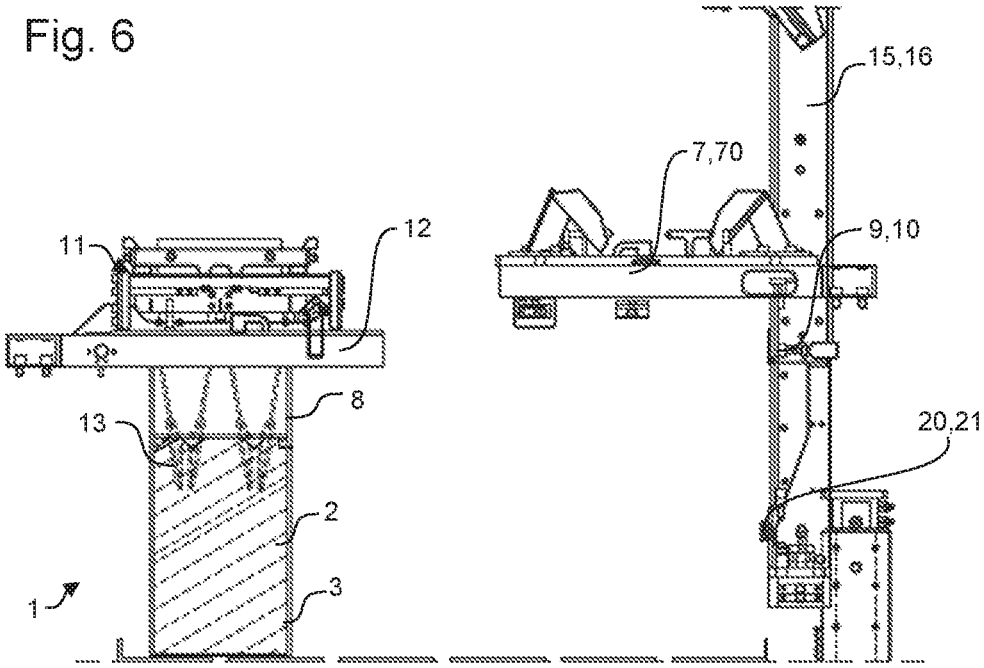
Figure 7:
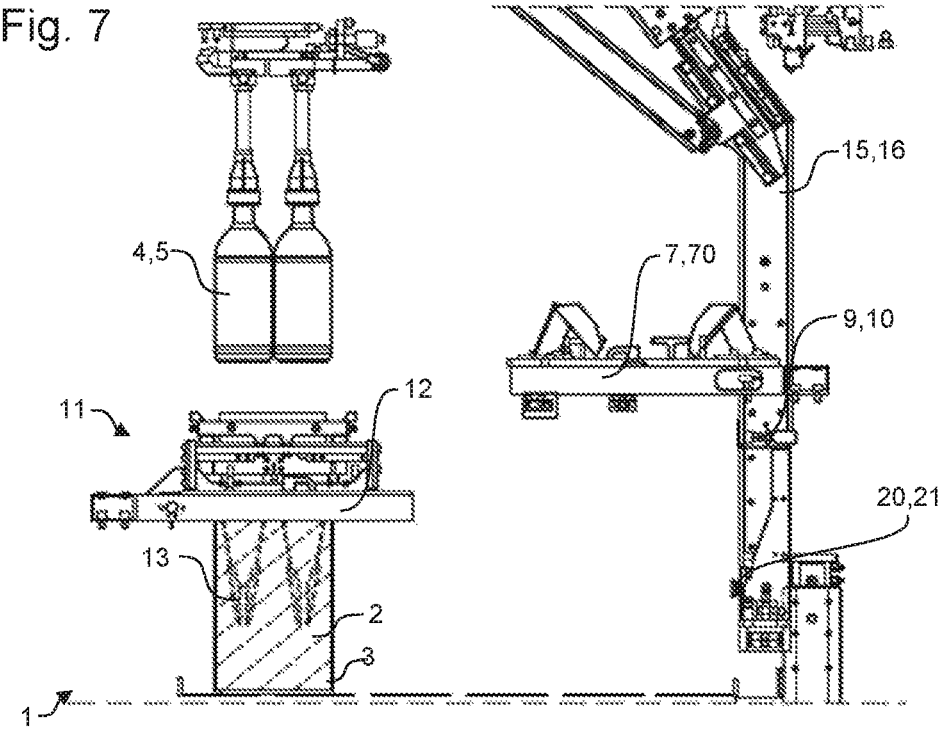
Figure 8:
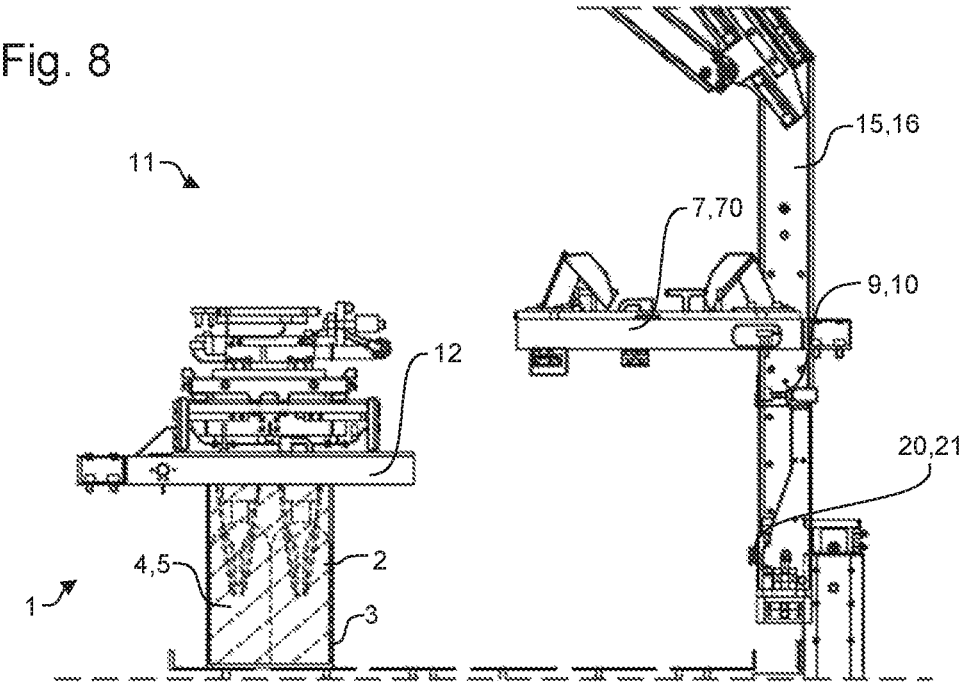

The partition 2 is inserted only partly into the box 3 by the placement device 6, in particular only so far that a section of the top connecting web of the partition 2 still protrudes beyond the top box flaps 8 that are open toward the top (see FIG. 2). This means in particular that the partition 2 at this point in time is not standing on the base surface of the box 3, but rather disposed suspended partly inside the box 3 and partly protruding beyond the box 3. The partition 2 is then held and/or stabilized in this suspended position relative to the box 3 by a first holding device, for example a so-called partition holder 9. The partition holder 9 is a vacuum cup 10, for example. In this context, the partition holder 9 is disposed independently of the holding frame 7 within the packaging device 1. After the unfolded partition 2 is held and stabilized in such a manner, the placement device 6 with the partition expanding implement 62 moves away toward the top (see FIG. 3).

Furthermore, an additional, second holding device 20 can be provided for the box 3, which holding device 20 additionally holds and stabilizes the box 3. The second holding device 20 prevents, in particular, a relative movement of the box 3 in relation to the partition 2 that is being held and stabilized by the first partition holder 9. Analogously to the partition holder 9, the second holding device 20 can likewise be designed as vacuum cup 21 that suctions to a surface of the box 3 in order to hold and/or stabilize the box 3.

Together with the partition 2, which continues to be held in the same position relative to the box 3, the box 3 is then moved toward the article feed station 11 by a transfer device 15, for example by a pusher 16. It is preferably provided that the partition holder 9 is disposed at the transfer device 15 and is moved therewith toward the article feed station 11 such that the partition 2 continues to be held safely.

The second holding device 20 is coupled preferably mechanically to the partition holder 9 such that the partition holder 9 and the second holding device 20 are moved synchronously toward the article feed station 11. It is in particular provided that the partition holder 9 and the second holding device 20 are disposed at the transfer device 15 and are moved along therewith. The partition holder 9 is preferably disposed above the second holding device 20, because the partition holder 9 takes hold of the partition 2 above the box 3.

The box 3 is pushed over onto a second transport device (not illustrated here) of the packaging device 1, for example. While the holding frame 7 of the first supply station 70 is being removed from the box 3, the partition 2 continues to be held and/or stabilized by the partition holder 9 in the position relative to the box 3 (see FIG. 4). In addition, the box 3 is held and/or stabilized relative to the partition 2 by of the second holding device 20. Next, an article insertion frame 12 of the article feed station 11 moves so far downward that the insertion fingers 13 at least in some parts engage into the partial sections formed inside the box 3 by the partition 2, and the insertion fingers thus effectively prevent the partition 2 from collapsing (cf. FIG. 5). The insertion fingers 13 function, in particular, as stabilizing device that subsequently stabilize the disposition of the partition 2 inside the box 3. The partition 2 can now be released, for example by the vacuum of the vacuum cup 10 being dissipated. The connection between box 3 and second holding device 20 is simultaneously disengaged, for example by the vacuum of the vacuum cup 21 being dissipated. The transfer device 15 can then be returned together with the partition holder 9 and the second holding device 20 to its starting position at the first transport device of the first supply station 70 (see FIG. 6). The partition 2 is now positioned inside the box 3, on the base surface of the box 3. The article insertion frame 12 subsequently moves completely downward (see FIG. 7), with the insertion fingers 13 spreading the access openings of the compartments formed by the partition 2 apart, corresponding to the articles 4, and, if required, pressing them into the correct shape. The articles 4, for example bottles 5, can then be placed into the compartments formed by the partition 2 from above into the box 3 that has been accordingly fitted.

First, the partitions 2 can be placed into the box 3 by the packaging device 1, which is additionally equipped with a first holding device, for example a partition holder 9, and subsequent thereto the articles 4, in particular bottles 5, are placed into the box 3. This is advantageous, because in this way the labels on the articles 4 and/or the articles 4 themselves are better protected against damage than in a method where the articles 4 are placed into the box first and only after that the partitions are placed into the box. Gluing of the partition inside the box is not necessary with the packaging device 1 and the method described here, whereby an additional gluing station and/or soiling of the products by adhesives, in particular soiling of articles 4 and/or of bottles 5, or also of the box 3, is/are omitted. In addition, it is possible to use customary 3×2 A-partitions without having to improve their stability, for example, by using a more stable material or a more complexly structured partition. This would, however, imply the use of further implements in order to correspondingly prepare the partitions, thereby incurring higher costs for the method.

The embodiments, examples and alternatives of the preceding paragraphs, the claims, or the following figures and description, including any of their various aspects or respective individual features, may be taken independently or in any combination. Features described in connection with one embodiment are applicable to all embodiments, unless such features are incompatible.

If illustrations and aspects are generally referred to as being "schematic" in the context of the figures, this is by no means intended to imply that the illustration of the figures and their description are of inferior significance with regard to the disclosure of the invention. The person skilled in the art is fully capable of gathering sufficient information from the schematically and abstractly drawn illustrations for facilitating the understanding of the invention without the understanding being in any way impaired by, for example, the size ratios of the articles 4 and/or of parts of the packaging device 1 or of other of the drawn elements being drawn and being potentially not precisely true to scale. On the basis of the more concretely explained realizations of the method according to the invention and on the basis of the more concretely explained functionality of the packaging device 1 according to the invention in the figures, the person skilled in the art as a reader is thus enabled to derive a better understanding of the inventive idea, which is formulated in a more general and/or more abstract manner in the claims and in the general part of the description.

LIST OF REFERENCE CHARACTERS

1 Packaging device
2 Partition
3 Box
4 Article
5 Bottle
6 Placement device
7 Holding frame
8 Top box flap
9 Partition holder
10 Vacuum cup
11 Article feed station
12 Article insertion frame
13 Insertion finger
15 Transfer device
16 Pusher
20 Second holding device
21 Vacuum cup
60 Second supply station
62 Partition expanding implement
70 First supply station

The invention claimed is:

1. A packaging device (1) for fitting an external package (3) with a dividing element (2) and for filling a divided external package (3) with articles (4), the packaging device (1) comprising:

a first supply station (70) for external packages (3) that are open on one side;

a second supply station (60) for expanded or unfolded dividing elements (2);

a placement device (6) that places the expanded or unfolded dividing element (2) into the supplied external package (3);

at least one holding device (9) that holds or stabilizes the expanded or unfolded dividing element (2) inside the external package (3) prior to the articles (3) being placed therein, wherein the at least one holding device (9) holds the at least one section of the dividing element (2) protruding out of the external package (3); and an article feed station (11) that places the articles (4) into the divided external package (3).

2. The packaging device (1) of claim 1, wherein the at least one holding device (9) holds or stabilizes the at least one section of the dividing element (2) protruding out of the external package (3) prior to and during placement of the articles (4) into the divided external package (3).

3. The packaging device (1) claim 2, further comprising a transfer device (15) that transfers the external package (3), fitted with the dividing element (2), from the placement device (6) to the article feed station (11).

4. The packaging device (1) of claim 3, wherein the holding device (9) moves with the transfer device (15).

5. The packaging device (1) of claim 4, wherein the article feed station (11) comprises at least one stabilizing device (13) that holds or stabilizes the dividing element (2) inside the external package (3) within the article feed station (11).

6. The packaging device (1) of claim 5, wherein the at least one stabilizing device (13) is an aid for insertion of the articles (4) into the divisions of the external package (3) that are formed by the dividing element (2).

7. A method for fitting an external package (3) within a packaging device (1) with a dividing element (2) for the formation of individual divisions for articles (4) to be disposed in the external package (3), the method comprising:

supplying an external package (3) that is open at least on one side;

supplying an expanded or unfolded dividing element (2);

placing the supplied and expanded or unfolded dividing element (2) into the supplied external package (3), wherein at least one section of the dividing element (2) protrudes out of the external package (3); and holding the at least one section of the dividing element (2) protruding out of the external package (3).

8. The method of claim 7, further comprising holding the at least one section of the dividing element (2) protruding out of the external package (3) prior to and while the articles (3) are being placed therein.

9. The method of claim 8, further comprising:

holding the section of the dividing element (2) that is protruding out of the external package (3) by a holding device (9) during transferring the external package (3) to an article feed station (11) and at least temporarily during the preparation of the external package within the article feed station (11);

completely inserting the dividing element (2) into the external package (3) within the article feed station (11); and holding or stabilizing the dividing element (2) disposed completely inside the external package (3) by a stabilizing device (13) of the article feed station (11) while the articles (4) are being placed therein.

10. The method of claim 9, wherein the stabilizing device (13) of the article feed station (11) supports the insertion of the articles (4) into the divisions of the external package (3) that are formed by the dividing element (2).

* * * * *